US012076605B2

(12) United States Patent
Sun

(10) Patent No.: US 12,076,605 B2
(45) Date of Patent: Sep. 3, 2024

(54) ADJUSTABLE DUMBBELL AND ITS USE METHOD

(71) Applicant: GAOYOU KANGSHENG MACHINERY CO., LTD., Jiangsu (CN)

(72) Inventor: Bisheng Sun, Jiangsu (CN)

(73) Assignee: GAOYOU KANGSHENG MACHINERY CO., LTD., Jiangsu (CN)

( * ) Notice: Subject to any disclaimer, the term of this patent is extended or adjusted under 35 U.S.C. 154(b) by 0 days.

(21) Appl. No.: 17/281,832

(22) PCT Filed: Mar. 29, 2021

(86) PCT No.: PCT/CN2021/083687
§ 371 (c)(1),
(2) Date: Mar. 31, 2021

(87) PCT Pub. No.: WO2022/007441
PCT Pub. Date: Jan. 13, 2022

(65) Prior Publication Data

US 2023/0120364 A1 Apr. 20, 2023

(30) Foreign Application Priority Data

Jul. 10, 2020 (CN) ..... 202010660333.2

(51) Int. Cl.
*A63B 21/075* (2006.01)
*A63B 21/072* (2006.01)

(52) U.S. Cl.
CPC ..... *A63B 21/075* (2013.01); *A63B 21/0726* (2013.01); *A63B 21/0728* (2013.01)

(58) Field of Classification Search
CPC ..... A63B 21/0726; A63B 21/0728; A63B 21/00065; A63B 71/0619; A63B 21/072–075
See application file for complete search history.

(56) References Cited

U.S. PATENT DOCUMENTS 5,839,997 A * 11/1998 Roth ..... A63B 21/0728 482/107
2004/0005968 A1* 1/2004 Crawford ..... A63B 21/0607 482/106
2006/0189458 A1* 8/2006 Walkerdine ..... A63B 21/0728 482/106
2007/0225132 A1* 9/2007 Liu ..... A63B 21/075 482/106

(Continued)

*Primary Examiner* — Joshua Lee
*Assistant Examiner* — Catrina A Letterman

(57) ABSTRACT

The invention relates to an adjustable dumbbell and its use method. The dumbbell comprises a base and a dumbbell body, the dumbbell body comprises a handle and a bell piece, the handle is a combination of a central shaft and a handle sleeve, the handle is also connected with an indexing plate, a gear piece and a bell piece box, the ends on both sides of the central shaft are provided with a snap ring groove and a gear step from the outside to the inside, and the indexing plate is provided with a lock The bell box is connected with a bell box cover, the bell box cover is connected with a locking leaf spring and a steel ball spring, the locking leaf spring is connected with a locking leaf, and the steel ball spring is connected with a steel ball.

4 Claims, 5 Drawing Sheets

(56) References Cited

U.S. PATENT DOCUMENTS

| | | | | |
|---|---|---|---|---|
| 2008/0026921 | A1* | 1/2008 | Liu | A63B 21/075<br>482/107 |
| 2009/0042700 | A1* | 2/2009 | Liu | A63B 21/075<br>482/107 |
| 2016/0089575 | A1* | 3/2016 | Smith | A63B 21/0726<br>482/5 |
| 2016/0166873 | A1* | 6/2016 | Liu | A63B 21/0726<br>482/107 |
| 2022/0176186 | A1* | 6/2022 | Chen | A63B 21/075 |
| 2022/0249898 | A1* | 8/2022 | Jiang | A63B 21/0728 |

* cited by examiner

ADJUSTABLE DUMBBELL AND ITS USE METHOD

CROSS-REFERENCE TO RELATED APPLICATIONS

This Application is a national stage application of PCT/CN2021/083687. This application claims priorities from PCT Application No. PCT/CN2021/083687, filed Mar. 29, 2021, and from the Chinese patent application 202010660333.2 filed Jul. 10, 2020, the content of which are incorporated herein in the entirety by reference.

TECHNICAL FIELD

The invention relates to the dumbbell technical field, in particular to an adjustable dumbbell and a use method thereof.

BACKGROUND

Dumbbell is a kind of auxiliary equipment for weight lifting and fitness exercise. It has simple structure and easy to use. It can be used for muscle strength training and muscle compound action training.

At present, there are two kinds of dumbbells in the market: fixed weight and adjustable weight. The dumbbell with fixed weight is mainly made of pig iron, with iron bars in the middle and solid balls at both ends. With the increase of exercise intensity of users, it is necessary to purchase and replace dumbbells of different weights, which undoubtedly increases the cost. The weight adjustable dumbbell is similar to the reduced barbell. In weight lifting or fitness exercise, the weight can be increased or decreased by putting round iron pieces with different weights on both ends of the short iron bar. However, the dumbbell pieces need to be removed manually with the help of spanner and other tools, and the adjusted weight also needs to be calculated manually, which is troublesome and inconvenient to use.

The Chinese patent (CN110665168a) discloses a weight adjustable dumbbell, which includes a rod body. The two ends of the rod body are symmetrically provided with an annular cavity, the annular cavity is surrounded by a side rod, the side rod extends out of the annular cavity, the annular cavity is provided with a spring, one end of the spring contacts with the inner wall of the annular cavity, the other end is provided with an annular washer, and the end of the side rod is connected with the inner wall of the annular cavity The outer end is provided with a pin body, between the pin body and the annular washer is provided with a dumbbell piece sheathed on the side bar, one side of the dumbbell piece contacts with the annular washer, and the other side contacts with the pin body. Compared with the prior art, the invention has the advantages of adjustable weight and stable fixation. It has high practical value and commercial value. However, the invention also has the disadvantages of manual rotation to adjust the weight, the weight on both sides of the dumbbell can not be controlled and balanced, and the scale can not be visually displayed.

Based on this, it is necessary to design a weight adjustable dumbbell, which can solve the problems of manual removal of the bell piece, such as inconvenient operation, uncontrollable weight, non intuitive weight display, poor safety and so on.

SUMMARY

The purpose of the invention is to provide an adjustable dumbbell aiming at the shortcomings of the prior art, which can automatically select the weight to be used according to the different angles of the handle rotation, has simple structure and convenient operation, can intuitively display the scale of weight adjustment, control the weight balance, can avoid the accident of bell falling due to unreliable locking, and improves the safety.

In order to achieve the above purpose, the invention provides the following technical scheme: an adjustable dumbbell includes a base and a dumbbell body, the dumbbell body includes a handle and a bell piece, the handle is a combination of a central shaft and a handle sleeve, the handle is also connected with an dividing disc, a shift piece and a bell box, and the ends on both sides of the central shaft are provided with a snap spring groove and a gear step from the outside to the inside, The dividing disc is provided with a locking piece positioning groove and a ball shift hole, the bell box is connected with a bell box cover, the bell box cover is connected with a locking piece spring and a ball spring, the locking piece spring is connected with a locking piece, the locking piece is connected with a steel pin, and the ball spring is connected with a steel ball.

Preferably, there is a partition wall with the same spacing distance in the middle of the bell slot, so that each bell is placed at the same distance. When the bell is placed naturally, it can stay at the same vertical angle with the same opening direction without adjustment.

Preferably, the handlebar sleeve is a hollow cylinder with a large semicircle hole, which can be directly die cast on the central shaft, or the prepared hollow cylinder with a large semicircle hole in the center can be sheathed on the central shaft to prevent the handlebar sleeve from sliding with the central shaft at the same time.

Preferably, the central shaft is rod-shaped, and its cross section is large semicircle, that is, a circle is cut off, and the snap spring groove is a circle of depression on the central shaft.

Preferably, the gear step comprises N steps, n is a natural number greater than or equal to 2, N steps are notches on the central axis, the notch depth of the first step is the shallowest and deepens in turn, and the N steps are arranged clockwise or counterclockwise in turn, the starting position of the N steps on the outer side of the central axis is the same, and the length of the first step is the shortest in the middle direction of the central axis It is the longest and shortened in turn.

Preferably, the dividing disc is a circular plate with a notch, in which the radius of one part of the circle is slightly larger than that of the other parts, and is connected with the central axis through a snap spring groove and a large semicircle dividing disc limiting hole in the center of the dividing disc, the locking piece positioning groove is a groove uniformly distributed on the periphery of the large semicircle of the smaller radius part of the dividing disc, and the ball shift hole is uniformly distributed on the inner side of the dividing disc The number of the positioning slots of the locking piece is n+1, which includes a starting gear, and the heights of the two sides of the starting gear and the maximum gear are not consistent, which has the positioning function; the number of the large semicircles of the ball shift holes located in the smaller radius part is equal to the number of the steps with different rotation angles on the position steps, and the ball shift holes are one-to-one corresponding to the position steps.

Preferably, the shift piece is a circle, and the positioning structure of the central axis is a large semicircle type limit hole in the center of the shift piece. The surface of the shift piece contains a gear mark, and the gear mark is a number, which is consistent with the number of locking piece positioning slots of the dividing disc. Except for the minimum gear mark, the gear mark corresponds to the gear step one by one.

Preferably, the gear identification can be hidden, and only one corresponding weight gear identification is displayed each time the weight is adjusted.

Preferably, the bell piece is a large semicircle with a flat bottom, the control hole is located at the intersection of the positioning opening and the center of the bell piece, the control hole can make the handle pass through, and the flat bottom has the orientation function, so that the bell piece is always in a unified opening direction in the bell piece groove.

Preferably, the bell box is an elliptic cylinder, and is provided with a partition wall for fixing the bell pieces with equal distance. One side of the elliptic column is provided with a semicircle hole of the bell box, and the semicircle hole of the bell box and the control hole of the bell can be connected through the gear step.

Preferably, the bell box is also provided with a bell box cover, the bell box cover is a cylinder, a plurality of holes for connecting the snap spring groove, the locking piece spring and the ball spring are arranged inside the bell box cover, a baffle is also arranged on the collar box cover, and the baffle is connected with the central shaft through the snap spring groove.

The use process of the invention is:

1. When the dumbbell body is placed on the base, the unlocking device gives the locking piece spring a thrust, which makes the locking piece separate from the positioning groove of the dividing disc, and the device is in the unlocking state.
2. When rotating the handle, the gear step can rotate through the bell plate and bell slot to different angles, and the weight of dumbbell lifting can be selected randomly.
3. When rotating the handle, the ball spring can drive the ball to rotate on the dividing disc and fall into the ball shift hole, and can simultaneously locate the corresponding gear step on the central shaft to realize the function of gear adjustment and locking.
4. When the handle is rotated, the text mark on the shift piece shows the weight of the bell plate during gear adjustment and locking.
5. When the proper weight is selected, the dumbbell is lifted, the force of unlocking device to the spring of the locking piece disappears, the locking piece is inserted into the locating groove of the locking piece, and the dividing disc, bell box and shift piece enter the locking state.

Compared with the prior art, the invention has a beneficial technical effect:

1. The invention uses the unlocking device to increase the thrust to the locking piece spring, realizes the lock and unlocking of the dumbbell body, and has simple structure, convenient and quick;
2. The locking piece is used to control the rotation of dumbbell body. When the locking piece is inserted into the dividing disc, the handle, bell plate and bell box will not move randomly, and the bell plate can be safely fixed on the handle, and the operation process is safe and reliable, and the failure rate is low;
3. The invention automatically selects different weights by rotating the handle to different angles, and does not need to manually dismantle and add the counterweight bell plate, which is convenient to operate and easy to control;
4. The invention clearly and intuitively displays the weight of dumbbell and effectively controls the weight balance of both sides through the adjustment of the steel ball on the dividing disc and the text mark of the shift piece;
5. The invention is only connected with various parts through the central axis, with few accessories, simple structure and easy assembly;
6. The invention does not need to buy and replace bell pieces of different weights continuously, thus reducing the cost.

DESCRIPTION OF FIGURES

The invention is further described in combination with the drawings and the embodiments.

In the above figures: 1. Base; 2. Handle; 3. Bell piece; 4. Bell piece groove; 5. Unlocking device; 6. Central shaft; 7. Handle sleeve; 8. Snap spring groove; 9. Gear step; 10. Dividing disc; 11. shift piece; 12. Bell box; 13, bell box cover; 14, locking piece positioning groove; 15, ball shift hole; 16, locking piece spring; 17, locking piece; 18, ball spring; 19, ball; 20, gear identification; 21, partition wall; 22, starting gear; 23, positioning opening; 24, control hole; 25, bell box isolation wall; 26, semicircular hole; 27. dividing disc limiting hole; 28. Gear plate limit hole; 29. Baffle.

MODE OF CARRYING OUT THE INVENTION

The technical scheme of the present invention will be described in detail by means of embodiments with reference to the drawings. It should be noted here that the description of these embodiments is used to help understand the invention, but does not constitute a limitation of the invention.

Example 1

The embodiment mainly introduces the main structure of the invention.

Figure 1:
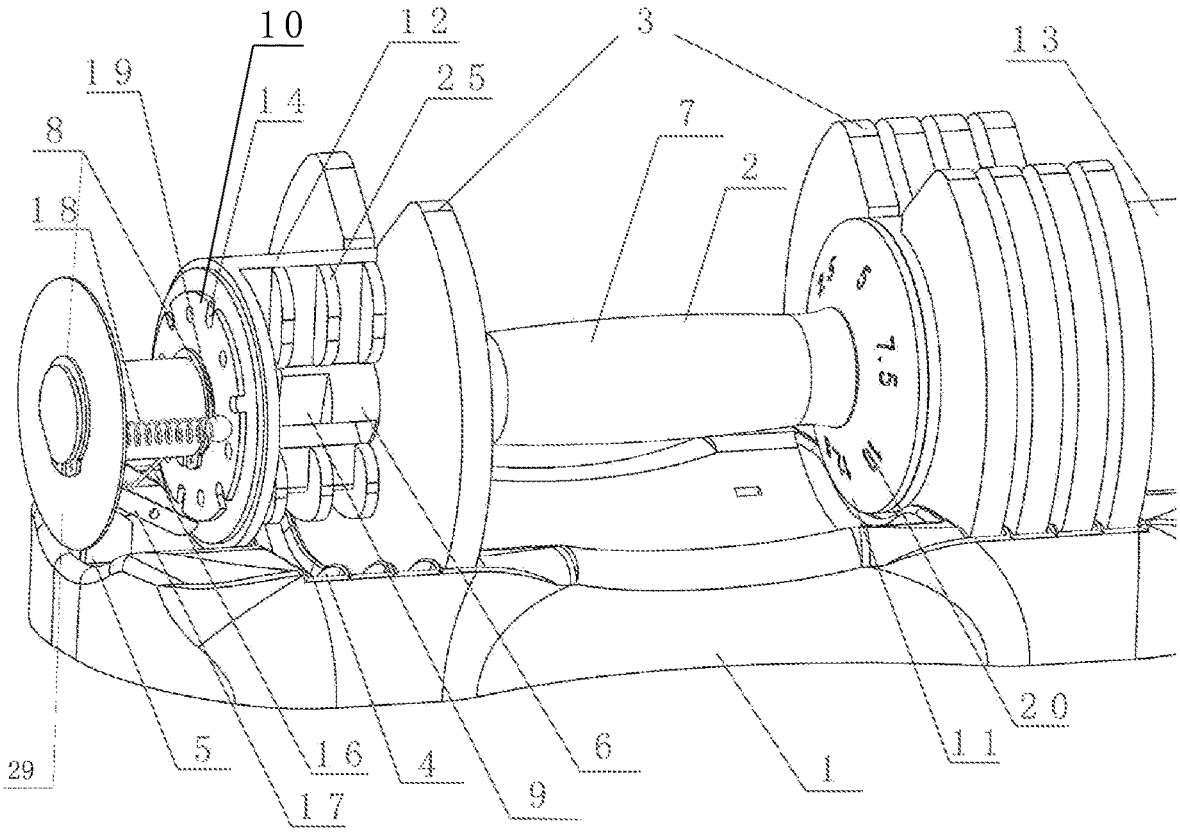
FIG. 1 is the structural diagram of the locking piece unlocking state when the dumbbell body is placed on the base.

As shown in FIG. 1, it shows the structure of the locking piece unlocking state when the dumbbell body is placed on the base. An adjustable dumbbell comprises a base 1 and a dumbbell body. The base 1 is provided with a bell piece groove 4 and an unlocking device 5. The dumbbell body comprises a handle 2 and a bell piece 3. The handle 2 is a combination of a central shaft 6 and a handle sleeve 7. The ends on both sides of the central shaft 6 are provided with a snap spring groove 8 and a gear step 9 from the outside to the inside. The central shaft 6 is also connected with a dividing disc 10, a shift piece 11 and a bell box 12 The dividing disc 10 is provided with a locking piece positioning groove 14 and a ball shift hole 15, the bell box 12 is connected with a bell box cover 13, the bell box cover 13 is connected with a locking piece spring 16 and a ball spring 18, the locking piece spring 16 is connected with a locking piece 17, the locking piece 17 is connected with a steel pin, the ball spring 18 is connected with a steel ball 19, and the shift piece is provided with a gear mark 20, The bell box 12 is provided with a bell box isolation wall 25, and the bell box cover 13 is connected with a baffle 29.

Figure 2:
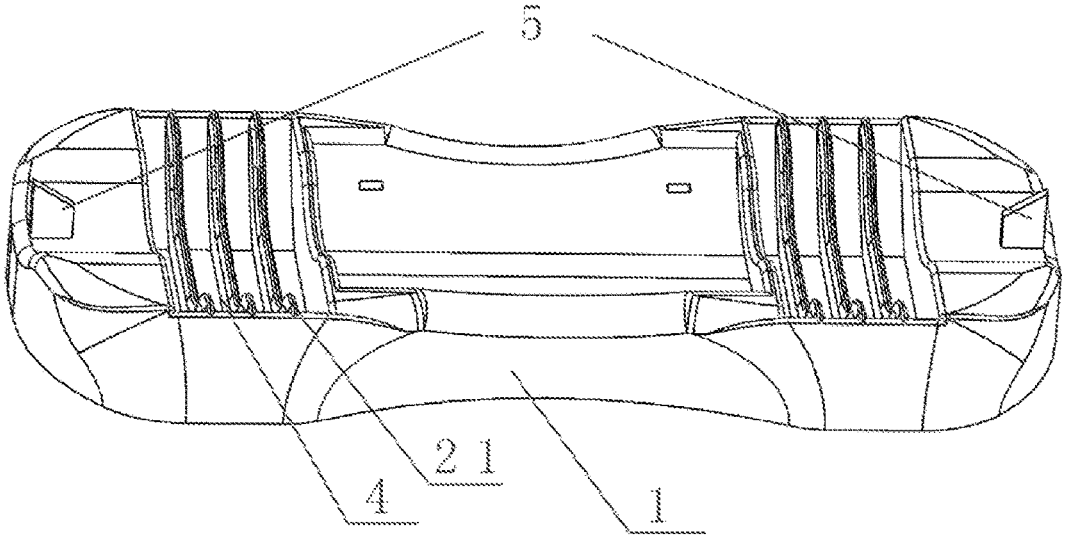
FIG. 2 is a structural diagram of the base of the present invention.

As shown in FIG. 2, it shows the structure of the base 1 of the present invention. The base 1 contains a bell slot 4 and an unlocking device 5. The middle of the bell slot 4 is provided with a partition wall 21 with the same distance, so that each bell 3 is placed at the same distance. When the bell 3 is placed naturally, it can stay at the same vertical angle and the opening direction is the same without adjustment. The unlocking device 5 is located at the same position on both sides of the base 1, the unlocking device 5 is a right angle trapezoid with an upper bottom on the side near the center of the base 1.

Figure 4:
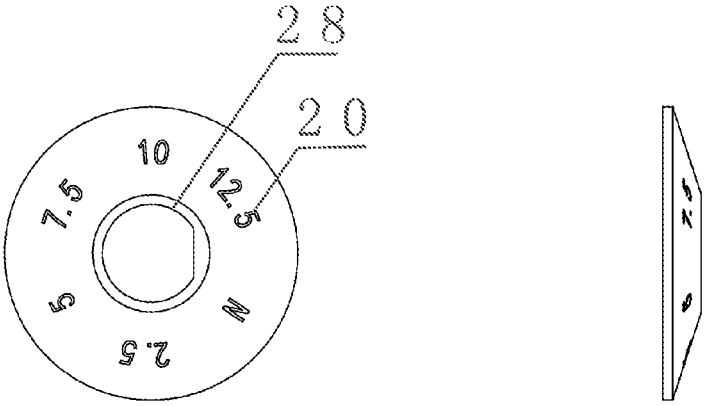
FIG. 4 is a structural diagram of the shift piece of the present invention.

As shown in FIG. 4, it shows the structure of the shift piece 11 of the present invention. The shift piece 11 is circular, and the positioning structure with the central shaft 6 is a large semicircle stop hole 27 in the center of the shift piece 11, and the surface of the shift piece 11 contains a stop mark 20.

Figure 5:
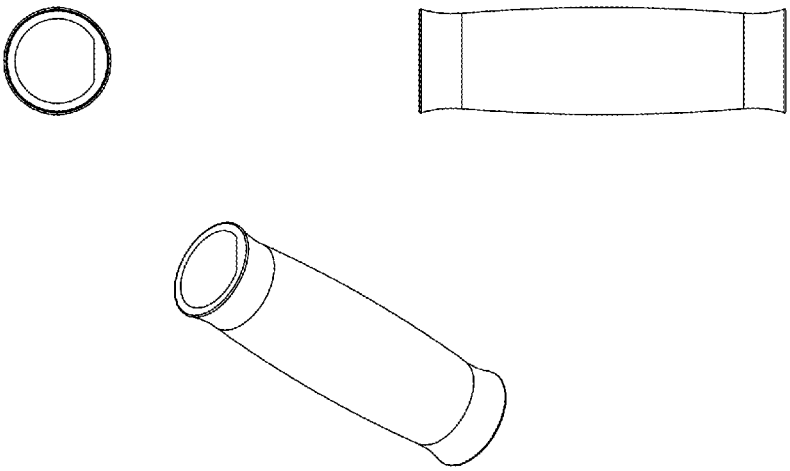
FIG. 5 is a structural diagram of the handle sleeve of the present invention.

As shown in FIG. 5, it shows the structure of the handlebar sleeve 7 of the invention. The handlebar sleeve 7 can be directly die cast on the central shaft 6, or the prepared cylinder with a large semicircular hole in the center can be sheathed on the central shaft 6 to prevent the handlebar sleeve 7 from sliding with the central shaft 6.

Figure 6:
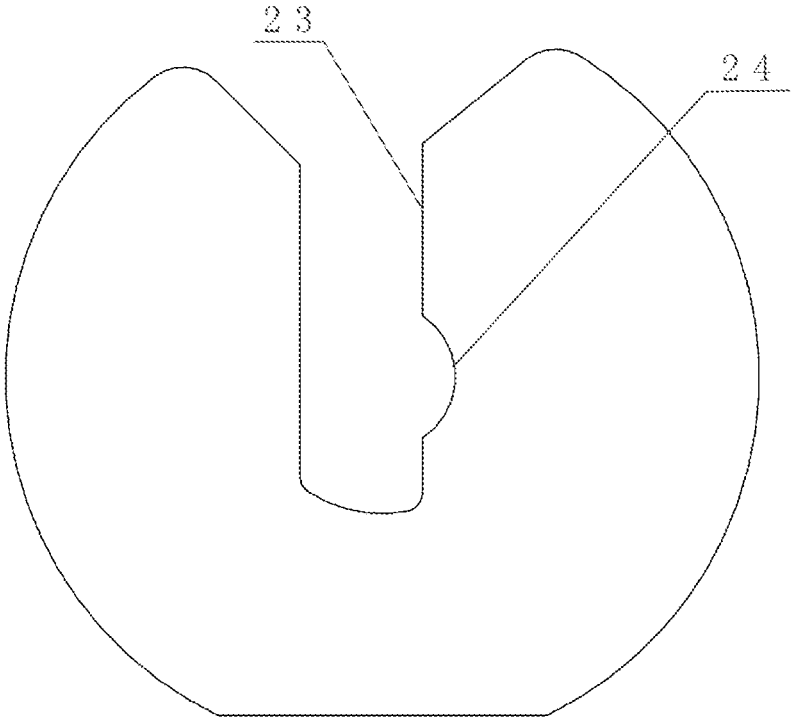
FIG. 6 is a structural diagram of the bell piece of the present invention.

As shown in FIG. 6, it shows the structure of the bell piece 3 of the present invention. The bell piece 3 is a large semicircle with a flat bottom, and the control hole 24 is located at the intersection of the positioning opening 23 and the bell piece center.

Figure 7:
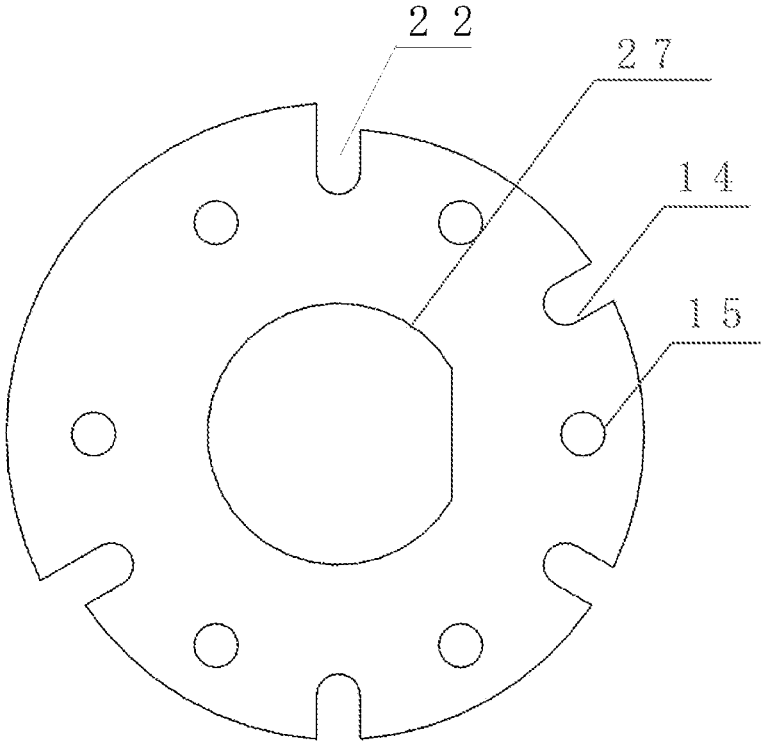
FIG. 7 is a structural diagram of the dividing disc of the present invention.

As shown in FIG. 7, it shows the structure of the dividing disc 10 of the present invention. The dividing disc 10 is a circular plate with a notch, in which the radius of one part of the circle is slightly larger than that of the other parts. It is connected with the central shaft 6 through a snap spring groove 8 and a large semicircle dividing disc limiting hole 27 in the center of the dividing disc 10. The locking piece positioning groove 14 is a groove distributed on the periphery of the dividing disc 10, and the ball shift hole 15 is a round hole evenly distributed on the inner side of the dividing disc.

Figure 8:
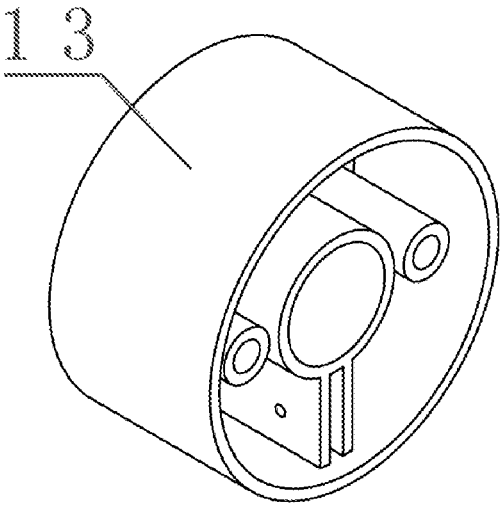
FIG. 8 is a structural diagram of the bell box cover of the present invention.

As shown in FIG. 8, it shows the structure of the bell box cover 13 of the present invention. The bell box cover is a cylinder, which contains a plurality of holes for fixing and placing the locking piece spring 16, the locking piece 17, and the ball spring 18. The collar box cover is also provided with a baffle 29, which is connected with the central shaft 6 through a snap spring groove 8.

Figure 9:
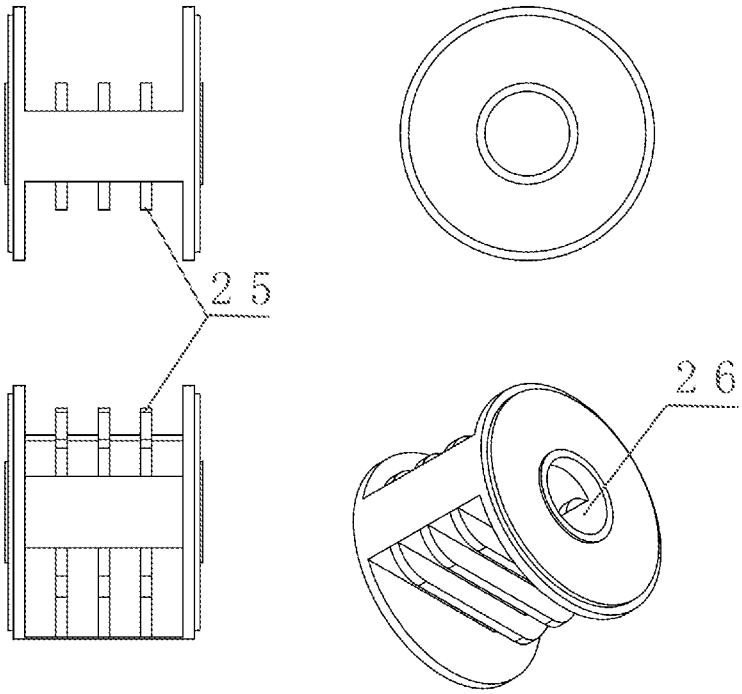
FIG. 9 is a structural diagram of the bell box of the present invention.

As shown in FIG. 9, it shows the structure of the bell box 12 of the present invention. The bell box 12 is an elliptic cylinder, and is equipped with a bell box isolation wall 25 for fixing the bell pieces with equal distance. One side of the elliptic column contains a semicircular hole 26.

The embodiment has simple structure, only connects with each part through the central shaft, has less accessories, simple structure, and is easy to assemble, which makes it very easy for the user to select the weight of the dumbbell.

Example 2

The embodiment is carried out on the basis of the above embodiment 1, and mainly introduces the unlocking device of the invention.

The same points as those in embodiment 1 will not be repeated.

Furthermore, as shown in FIG. 1, the preferred embodiment of the present invention shows the structure of the locking piece unlocking state when the dumbbell body is placed on the base. When the dumbbell body is placed on the base 1, the unlocking device 5 applies force to the locking piece spring 16 to push the locking piece 17 to separate the locking piece 17 from the locking piece positioning groove 14. At this time, the unlocking device 5 is in the unlocking state, and the handle 2 can rotate to select the gear.

Furthermore, as shown in FIG. 2, it shows the structure of the base 1 of this embodiment. The base 1 contains a bell slot 4 and an unlocking device 5. The unlocking device 5 is located on both sides of the base 1, and the unlocking device 5 is a right angle trapezoid with an upper bottom on the side near the center of the base 1.

Furthermore, as shown in FIG. 7, it shows the structure of the dividing disc 10 of this embodiment. The locking piece positioning groove 14 on the dividing disc 10 is a groove evenly distributed on the periphery of the large semicircle of the smaller radius part of the dividing disc 10; the number of the locking piece positioning groove 14 is n+1, including a starting gear 22, and the heights of the two sides of the starting gear 22 and the maximum gear are inconsistent, which has the positioning function.

Figure 10:
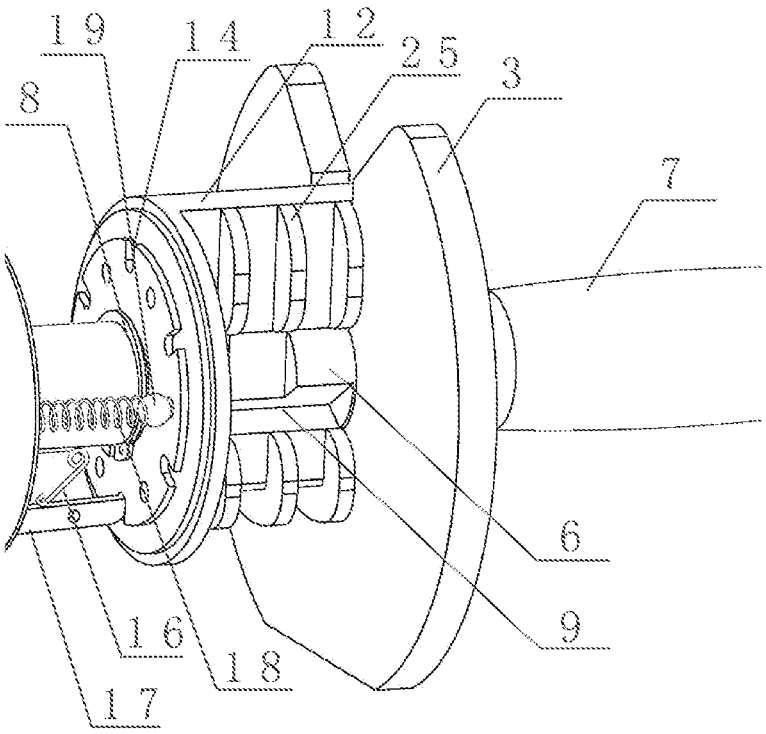
FIG. 10 is a structural diagram of the state of the dumbbell when the dumbbell body is detached from the base

Furthermore, as shown in FIG. 10, when the dumbbell body leaves the base 1, the thrust on the locking piece 17 disappears and it is inserted into the lock piece positioning groove 14 of the dividing disc 10 to lock the rotation of the handle 2, so as to prevent the locking piece from sliding and causing injury.

In this embodiment, the unlocking device is used to increase the thrust to the locking piece spring to realize the locking and unlocking of the dumbbell body, which is simple in structure, convenient and fast; the locking piece is used to control the rotation of the dumbbell body, when the locking piece is inserted into the dividing disc, the handle, the bell plate and the bell plate box will not move at will, the bell plate can be safely fixed on the handle, and the use process is safe and reliable, with low failure rate.

When the dumbbell body is placed on the base 1, the unlocking device 5 applies force to the locking piece spring 16 to push the locking piece 17 to separate the locking piece 17 from the locking piece positioning groove 14. At this time, the unlocking device 5 is in the unlocking state, and the handle 2 can rotate to select a gear; when the handle 2 rotates, the ball spring 18 can press the steel ball 19 to rotate on the dividing disc 10, and The steel ball 19 can fall into the steel ball shift hole 15, which can realize the function of adjusting gear and locking; when the handle 2 rotates, the shift piece 11 will synchronously rotate to the required gear mark 20; when the dumbbell body leaves the base 1, the thrust of the locking piece 17 disappears and is inserted into the locking piece positioning groove 14 of the dividing disc 10, which locks the rotation of the handle 2.

Example 3

The embodiment is carried out on the basis of embodiment 1 or 2, and mainly introduces the gear adjusting device of the invention.

The same as the above embodiments will not be described in detail.

Figure 3:
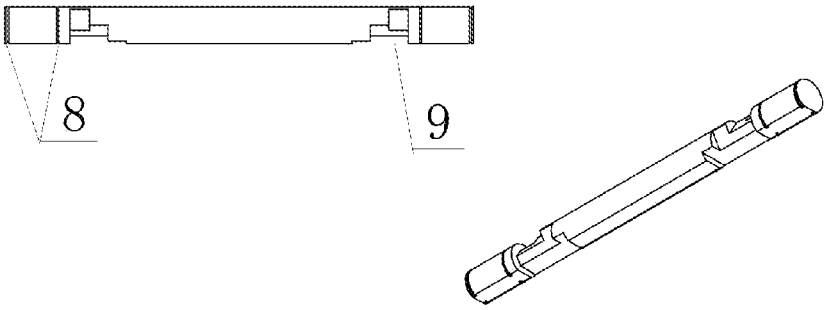
FIG. 3 is a structural diagram of the central shaft of the present invention.

Furthermore, as shown in FIG. 3, it shows the structure of the central shaft 6 of this embodiment. The central shaft 6 is rod-shaped, and its cross section is large semicircle, that is, the circle is cut off. The ends of both sides of the central shaft 6 are provided with a snap spring groove 8 and a gear step 9 from the outside to the inside. The gear step 9 includes N steps, n is a natural number greater than or equal to 2, and N steps are on the central shaft 6 The notch depth of the first step is the shallowest and deepens in turn, and the N steps are arranged clockwise or anticlockwise in turn. The starting position of the N steps on the outer side of the central axis 6 is the same, and the length of the first step is the longest and shortens in turn in the middle direction of the central axis 6.

Furthermore, as shown in FIG. 6, it shows the structure of the bell piece 3 of this embodiment. The bell piece 3 is a large semicircle with a flat bottom, and the control hole 24 is located at the intersection of the positioning opening 23 and the bell piece center.

Furthermore, as shown in FIG. 7, it shows the structure of the dividing disc 10 of this embodiment. The number of large semicircles on the smaller part of the radius of the ball shift hole 15 on the dividing disc 10 is equal to the number of steps with different rotation angles on the gear step 9, and the ball shift hole 15 corresponds to the gear step 9 one by one. When the handle 2 rotates, the ball spring 18 can press the ball 19, The steel ball 19 can fall into the ball shift hole 15 and realize the function of adjusting and locking.

Furthermore, as shown in FIG. 9, it shows the structure of the bell box 12 of this embodiment. The bell box 12 is an elliptic cylinder, and is equipped with a bell box isolation wall 25 for fixing the bell pieces with equal distance. One side of the elliptic column contains a semicircle hole 26, and the semicircle hole 26 and the control hole 24 can be connected through the gear step 9.

In this embodiment, different weights are automatically selected by rotating the handle to different gear steps, and it is convenient to operate and easy to control without manually removing and adding the counterweight bell piece.

Example 4

This embodiment is based on any one or any combination of embodiments 1-3, and mainly introduces the weight display device of the invention. The same as the above embodiments will not be described in detail.

Furthermore, as shown in FIG. 4, it shows the structure of the shift piece 11 of this embodiment, the shift piece 11 is circular, and the positioning structure of the central shaft 6 is the large semicircle dividing disc limiting hole 27 in the center of the shift piece 11, and the shift piece 11 surface contains the gear mark 20; the gear mark 20 is a number, which is consistent with the number of the locking piece positioning grooves 14 of the dividing disc 10, except for the minimum gear mark 20 When the handle 2 rotates, it will synchronously rotate to the required gear mark 20.

Further, the gear identification 20 can be hidden, and only one corresponding weight gear mark 20 is displayed each time the weight is adjusted.

Figure 11:
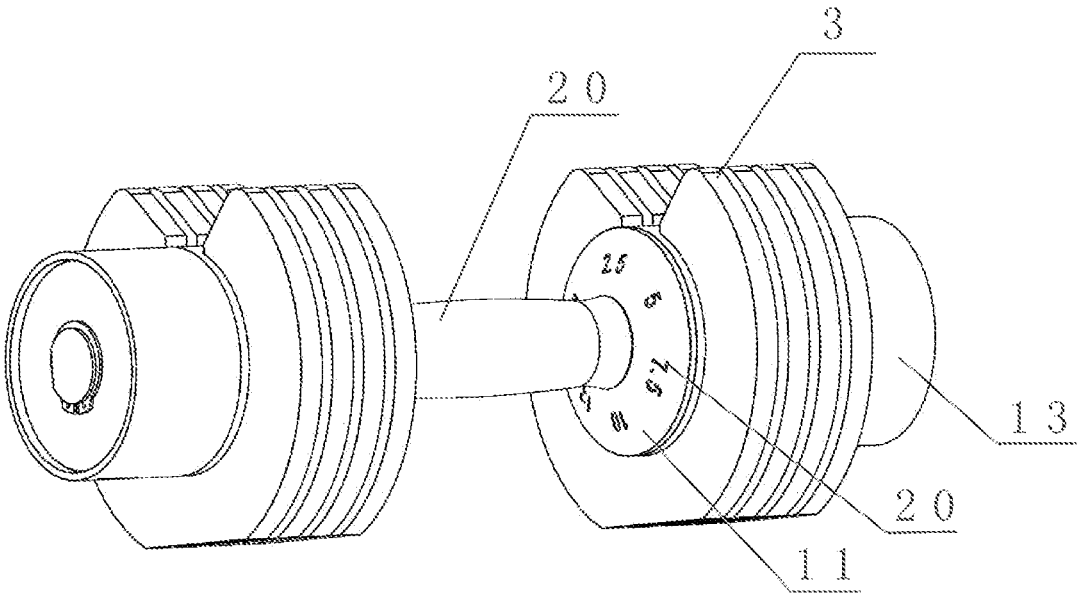
FIG. 11 is a structural diagram of the dumbbell body when it is used without the base.

Further, as shown in FIG. 11, it shows the structure of the dumbbell body in the embodiment when it is used when it is separated from the base. The shift piece can directly display the weight of the bell plates on both sides after the dumbbell adjustment.

The embodiment shows the weight of dumbbell clearly and intuitively by matching the gear adjustment of the steel ball on the dividing disc with the text mark of the shift piece, and effectively controls the weight balance of both sides.

The invention has been explained through the above embodiments, but it should be understood that the above embodiments are only used for the purposes of examples and explanations, rather than intended to limit the invention to the scope of the described embodiments. For those skilled in the art, the invention can have various changes and changes, including the combination and reorganization of technical features. Any modification, equivalent replacement, improvement, etc. made within the spirit and principle of the invention shall be included in the scope of protection of the invention.

The invention claimed is:

1. An adjustable dumbbell, comprising:

a base (1) and a dumbbell body; wherein:

the dumbbell body comprises a handle (2);

the handle (2) comprises a combination of a central shaft (6) and a handle sleeve (7), wherein the central shaft (6) is also connected with a dividing disc (10), a shift piece (11) and a bell box (12);

the bell box (12) is an elliptic cylinder, and is equipped with a bell box isolation wall (25) for fixing bell pieces with equal distance between the bell pieces and one side of the bell box (12) is provided with a semicircular hole (26), and the semicircular hole (26) of the bell box (12) and a control hole (24) of each of the bell pieces are connected via a gear step (9);

each of the bell pieces is a large semicircle with a flat bottom, and the control hole (24) of each of the bell pieces is located at an intersection of a positioning opening (23) and a bell piece center of each of the bell pieces;

the dividing disc (10) is provided with locking piece positioning grooves (14) and ball shift holes (15), wherein the dividing disc (10) is a circular plate, in which a radius of one part of the dividing disc (10) is larger than that of other parts of the dividing disc (10); the dividing disc is connected with the central shaft (6) through a snap spring groove (8) and a large semicircle dividing disc limiting hole (27) in a center of the dividing disc (10); the locking piece positioning grooves (14) are grooves distributed on a periphery of the dividing disc (10), and the ball shift holes (15) are round holes distributed on an inner side of the dividing disc;

the shift piece (11) is a circle, and a positioning structure for the central shaft (6) is a semicircle type dividing disc limiting hole (27) in a center of the shift piece (11);

a surface of the shift piece (11) contains a gear mark (20) corresponding to the locking piece positioning grooves (14) of the dividing disc (10);

the bell box (12) is connected with a bell box cover (13); the bell box cover (13) is connected with a locking piece spring (16) and a ball spring (18); the locking piece spring (16) is connected with a locking piece (17); the locking piece (17) is connected with the ball spring (18); and a steel ball (19) is connected with the ball spring (18);

the bell box cover (13) is a cylinder, which contains a plurality of holes for fixing and placing the locking piece spring (16), the locking piece (17), and the ball spring (18); the bell box cover (13) is also provided with a baffle (29), which is connected with the central shaft (6) through the snap spring groove (8);

when the dumbbell body is placed on the base (1), an unlocking device (5) applies a force to the locking piece spring (16) to push the locking piece (17) to separate the locking piece (17) from one of the locking piece positioning grooves (14) causing the unlocking device (5) to be in an unlocking state, wherein the handle (2) is configured to rotate to select a gear; wherein the unlocking device (5) is located at the same position on each of both sides of the base (1), the unlocking device (5) is a right angle trapezoid perpendicular to a surface of the base (1) and positioned adjacent to an outer edge of the base (1);

when the handle (2) rotates, the ball spring (18) causes the steel ball (19) to rotate on the dividing disc (10) and fall into one of the ball shift holes (15);

the shift piece (11) synchronously rotates to a required gear mark (20); and when the dumbbell body leaves the base (1), thrust on the locking piece (17) is removed and the locking piece (17) is inserted into one of the locking piece positioning grooves (14) of the dividing disc (10) to lock a rotation of the handle (2).

2. The adjustable dumbbell according to claim 1, wherein the base (1) is provided with a bell slot (4) and the unlocking device (5) and a middle of the bell slot (4) is provided with a partition wall (21).

3. The adjustable dumbbell according to claim 2, wherein the handle sleeve (7) is a hollow cylinder with a large semicircle hole in a center;

the central shaft (6) is rod-shaped and has a semicircular cross section; and the snap spring groove (8) is a depressed circle on the central shaft (6).

4. The adjustable dumbbell according to claim 3, wherein the gear step (9) comprises N steps, all of which are notches on the central shaft (6), where N is a natural number greater than or equal to 2;

a notch depth of a first step of the N steps is shallowest of the N steps;

the N steps are arranged clockwise or counterclockwise;

a starting position of the N steps is on an outer side of the central shaft (6); and a length of the first step is longest of the N steps.

* * * * *